US006227645B1

(12) United States Patent
Takahashi et al.

(10) Patent No.: US 6,227,645 B1
(45) Date of Patent: May 8, 2001

(54) LIQUID JET RECORDING HEAD AND ASSEMBLING METHOD THEREFOR

(75) Inventors: Wataru Takahashi; Masaki Inaba, both of Kawasaki; Ken Hosaka, Yokohama; Hisashi Fukai, Yokohama; Shin Ishimatsu, Yokohama; Ryoji Inoue; Shigeki Fukui, both of Kawasaki; Yohei Sato; Yoshihiko Yoshihara, both of Yokohama, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/427,611

(22) Filed: Oct. 27, 1999

(30) Foreign Application Priority Data

Oct. 26, 1998 (JP) ..... 11-303272
Oct. 27, 1998 (JP) ..... 10-321450

(51) Int. Cl.[7] ..... B41J 2/015; B41J 2/05
(52) U.S. Cl. ..... 347/20; 347/65
(58) Field of Search ..... 347/20, 40, 42, 347/50, 63, 65, 85–87

(56) References Cited

U.S. PATENT DOCUMENTS 5,095,321 * 3/1992 Saito et al. ..... 347/20
5,436,649 * 7/1995 Nakagomi et al. ..... 347/20
5,606,352 * 2/1997 Yamakawa et al. ..... 347/20
5,784,079 * 7/1998 Masuda et al. ..... 347/20

* cited by examiner

*Primary Examiner*—John Barlow
*Assistant Examiner*—Juanita Stephens
(74) *Attorney, Agent, or Firm*—Fitzpatrick, Cella, Harper & Scinto

(57) ABSTRACT

According to the present invention, a liquid jet recording head assembly method comprises the steps of assembling a pressing member with a reference member to which an element substrate is fixed, charging a forcing spring provided for the pressing member to obtain a gap through which a grooved top plate can be inserted, assembling, by means of the gap, the grooved top plate with the element, and releasing the charging of the forcing spring and using the force exerted by the forcing spring to press the grooved top plate against the element substrate, so as to secure the grooved top plate to the element substrate.

17 Claims, 12 Drawing Sheets

LIQUID JET RECORDING HEAD AND ASSEMBLING METHOD THEREFOR

BACKGROUND OF THE INVENTION

1. Field of the Invention

The present invention relates to a liquid jet recording head, for a liquid jet recording system, that for recording discharges, through fine discharge ports, droplets of a recording liquid and attaches the recording liquid to a recording medium, such as a recording paper sheet, and to a method for assembling such a recording head. In particular, the present invention pertains to a liquid jet recording head that includes a pressing member for securing, under pressure, a member in which are formed a plurality of discharge ports and liquid flow paths, and to a method for assembling such a recording head.

2. Related Background Art

Generally, a conventional liquid jetting recording head comprises: a plurality of fine discharge ports, through which a recording liquid is discharged; liquid flow paths, which communicate with the individual discharge ports; and discharge energy generating elements, which are located along the individual liquid flow paths. This recording head is so designed that a driving signal corresponding to recorded information is applied to the discharge energy generating element, and discharge energy is exerted to propel a recording liquid along a liquid flow path corresponding to the pertinent energy generating element, so that droplets of the recording liquid are ejected through the discharge ports for printing.

A liquid jet recording head of this type is constituted by an element substrate and a grooved top plate. A plurality of discharge energy generating elements (electro-thermal converting elements, etc.), which are precisely formed using a semiconductor manufacturing technique, are arranged on the element substrate. And accurately formed on an orifice plate and/or the grooved top plate, using a precise manufacturing means, such as a laser process means, are a plurality of discharge ports; a plurality of liquid flow path grooves, which communicate with the individual discharge ports; a common liquid chamber, which communicates with the flow path grooves; and a liquid reservoir. The element substrate and the grooved top plate are then arranged and bonded together, so that the discharge energy generating elements on the element substrate are aligned with corresponding flow paths and discharge ports in the grooved top plate. Following this, a pressing member, such as a spring, is used to apply pressure to the resultant structure, so that a uniform bonded condition is acquired in the vicinity of the discharge ports, and the element substrate and the grooved top plate are firmly secured to each other.

When assembling the element substrate, the grooved top plate and the pressing member, the energy generating elements, the discharge ports and the liquid flow path grooves must be aligned precisely, in micron order. Disclosed in Japanese Patent Application Laid-open Nos. 04-171130, 04-171126, 04-171163 and 05-004136 are well known liquid jet recording head manufacturing methods that provide for the precise alignment and the assembly of the element substrate and the grooved top plate. According to these manufacturing methods, to assemble an apparatus, first, the positions of the discharge energy generating elements formed on an element substrate are identified and stored as images. Then, a grooved top plate, in which discharge ports and liquid flow path grooves are formed, is temporarily mounted on the element substrate. The positions of the discharge ports and of the flow path grooves are compared with those of the discharge energy generating elements, and the relative positioning of the element substrate and the grooved top plate relative is adjusted to align the discharge energy generating elements with the discharge ports and the liquid flow path grooves. In addition, to prevent any change in the positional relationship, an ultraviolet setting adhesive is used to temporarily secure the grooved top plate to the element substrate. In the succeeding procedure, a pressing member, such as a spring, is assembled with the temporary unit comprising the element substrate and the grooved top plate in order to firmly bond to each other the faces of the element substrate and the grooved top plate.

The use of the pressing member can be dispensed with, and an adhesive can be applied to securely bond the element substrate to the grooved top plate; however, the adhesive may run and enter the liquid flow paths, and thereby change the chemical composition of the ink that is used as the recording liquid, or it may adversely affect and deteriorate the liquid ejection performance.

A liquid jet recording head using a pressing member is disclosed in, for example, Japanese Patent Application Laid-open No. 4-247953. In this publication, the pressing member is extended in the direction in which discharge ports are arranged, and is constituted by a pressing portion that applies pressure in the vicinity of the discharge ports in a grooved top plate, a U-shaped flexible portion that urges the pressing member in the direction in which the grooved top plate and a substrate element are bonded, and an engagement portion that is provided on both sides of the U-shaped flexible portion and engages a base plate. According to a method that uses the pressing member to secure the grooved top plate to the element substrate, the pressing member is bent and charged by supporting the portion of the U-shaped flexible portion that is near the pressing portion. In this state, the element substrate and the grooved top plate are assembled with the base plate that is temporarily fixed to the grooved top plate. Then, the pressing member is released so that the pressing portion of the pressing member can apply pressure to the grooved top plate, and the grooved top plate and the element substrate are joined together.

Recently, the precision provided by liquid jet recording apparatuses has increased, and a need has been expressed for improvements in the accuracy with which the discharge ports of liquid jet recording heads are positioned and in the exactness with which liquid droplets land on recording paper.

In order to improve the exactness with which liquid droplets land when they are ejected by a liquid jet recording head that comprises an element substrate, which is fixed to a reference member formed on a base plate, a grooved top plate, which is to be bonded to the element substrate and in which are formed a plurality of liquid flow path grooves corresponding to discharge energy generating elements and a plurality of discharge ports through which a recording liquid is discharged, and a pressing member, for forcing together the grooved top plate and the element substrate, the conditions, such as precision and stability, under which the grooved top plate and the substrate element are bound together must be improved.

However, for the conventional liquid jet recording head described above, in the procedure in which pressure is used to bond the grooved top plate to the element substrate, the following problems still remain. (1) Since the element substrate and the grooved top plate are temporarily fixed together using an ultraviolet setting adhesive, the accuracy with which these components are secured to each other may be changed due to a reduction in the volume of the adhesive after it is set, and a defect may occur that affects the precision that is currently requested for a recording head. Further, since the element of which the ultraviolet setting adhesive is composed melts in the ink that constitutes the recording liquid for the recording head, the composition of ink is changed and deterioration of the printing quality occurs. In addition, part of the projected ultraviolet rays used to set the adhesive may leak out, and may adversely affect the vision of workers in the vicinity. Furthermore, since to set the adhesive the ultraviolet rays must be projected for a predetermined period of time, and since the tact of the apparatus must be extended to install a light source for the ultraviolet irradiation, the cost of the apparatus is increased. (2) In order to assemble the pressing member with the base plate, the pressing member must be in the charged state because it must not contact the grooved top plate that was previously positioned. However, if the pressing member is in the charged state too long, the pressing force provided by the pressing member will be reduced and the pressing portion may be deformed. Therefore, the length of time the pressing member is held in the charged state should be as short as possible.

SUMMARY OF THE INVENTION

To resolve the above described conventional shortcomings, it is one object of the present invention to provide a liquid jet recording head, having a grooved top plate that can be accurately, stably and securely bonded to an element substrate by a pressing member, that can be easily manufactured and with which a precisely formed, high quality image can be obtained.

To achieve the above objective, according to the present invention, a liquid jet recording head comprises:

an element substrate, fixed to a reference member, whereon are formed a plurality of discharge energy generating elements for generating discharge energy for discharging which to eject a recording liquid;

a grooved top plate, to be bonded to the element substrate, for forming a plurality of liquid flow paths, which correspond to the discharge energy generating elements, and a plurality of discharge ports, which communicate with the liquid flow paths, for the discharge of the recording liquid; and a pressing member paired with the reference member, which it engages, between which the grooved top plate and the element substrate are held in order for the grooved top plate to be pressed against the element substrate, the pressing member including a pressing portion, extended in a direction in which the discharge ports are arranged, for applying pressure to the grooved top plate in the vicinity of the discharge ports, a flexible portion for flexibly supporting the pressing portion, an engagement portion for engaging the reference member, and flexible operating portions located on either end of the pressing portion to charge a spring urging force.

According to the liquid jet recording head of the present invention, before the grooved top plate is bonded to the element substrate, it is preferable that the pressing member be assembled with the reference member to which the element substrate is fixed.

According to the liquid jet recording head of the present invention, the flexible operating portions can be formed as elastically operable pieces that extend downward below the pressing portion. Alternatively, the flexible operating portions can be formed as elastically operable pieces that extend downward below the pressing portion and that are bent backward from the pressing portion in the liquid ejection direction.

According to the liquid jet recording head of the present invention, when the pressing member is assembled with the reference member, to which the element substrate is fixed, and when the spring urging force of the pressing member has not yet been charged, it is preferable that the pressing portion of the pressing member not contact the element substrate. Further, when the pressing member is assembled with the reference member, to which the element substrate is fixed, and when the forcing spring provided for the pressing member has not yet been charged, it is preferable that at least one part of the flexible operating portion of the pressing member be supported by the reference member, and that the pressing portion of the pressing member not contact the element substrate.

According to the liquid jet recording head of the present invention, it is preferable that the forcing spring provided for the pressing member, which is assembled with the reference member, be charged via the flexible operating portion, from below the reference member or from above the pressing member. It is also preferable that notches be formed on either side of the reference member through which operating members can be passed to charge the forcing spring provided for the pressing member.

According to the liquid jet recording head of the present invention, when the grooved top plate is inserted between the element substrate, which is fixed to the reference member, and the pressing portion of the pressing member, and when the pressing portion of the pressing member applies pressure in the vicinity of the discharge ports in the grooved top plate, it is preferable that the flexible operating portion of the pressing member be positioned at a distance from the reference member.

According to the present invention, provided is a liquid jet recording head assembly method whereby an element substrate, which is fixed to a reference member and on which are formed a plurality of discharge energy generating elements to generate discharge energy for the ejection of recording liquid, is bonded to a grooved top plate, in which are formed a plurality of liquid flow paths that correspond to the discharge energy generating elements and a plurality of discharge ports that communicate with the liquid flow paths for the ejection of the recording liquid, and whereby pressure exerted by a spring urging force of a pressing member secures the element substrate to the grooved top plate, the method comprising the steps of:

assembling the pressing member with the reference member to which the element substrate is fixed;

charging the spring urging force of the pressing member to obtain a gap through which the grooved top plate can be inserted;

assembling, by means of the gap, the grooved top plate with the element substrate; and releasing the charging of the spring urging force and by the spring urging force pressing the grooved top plate against the element substrate, so as to secure the grooved top plate to the element substrate.

According to the method of the present invention for assembling a liquid jet recording head, it is preferable that the pressing member include:

a pressing portion, which extends in a direction in which the discharge ports are arranged in the grooved top plate, for applying pressure to the grooved top plate in the vicinity of the discharge ports;

a flexible portion for flexibly supporting the pressing portion;

an engagement portion for engaging the reference member; and flexible operating portions, which are located at either end of the pressing portion, for charging a spring urging force.

According to the method of the present invention for assembling a liquid jet recording head, when the pressing member is assembled with the reference member and when the spring urging force of the pressing member has not yet been charged, it is preferable that the pressing portion of the pressing member not contact the element substrate. Further, it is preferable that at least one part of the flexible operating portion, which extends downward from the pressing portion of the pressing member, be supported by the reference member, and that the pressing portion of the pressing member not contact the element substrate.

According to the method of the present invention for assembling a liquid jet recording head, the forcing spring that is provided for the pressing member, which is assembled with the reference member, can be charged from below the reference member, or from above the pressing member. The spring urging force of the pressing member can also be charged by engaging, from below the reference member through notches that are formed in both sides of the reference member, the flexible operating portion of the pressing member.

According to the method of the present invention for assembling a liquid jet recording head, it is preferable that the grooved top plate be inserted between the pressing member, which is assembled with the reference member, and the element substrate; that the grooved top plate and the element substrate be moved to adjust their relative positions; and that the grooved top plate be pressed against and securely attached to the element substrate by pressure exerted by the spring urging force of the pressing member.

According to the liquid jet recording head and its assembling method of the present invention, for the pressing member, flexible operating portions or elastically operable pieces are formed at both ends of the pressing portion that contacts and presses against the grooved top plate. Thus, after the pressing member has been assembled with the reference member, the forcing spring of the pressing member can be charged via the flexible operating portions and the elastically operable pieces. In addition, the pressure provided by the pressing portion can be applied to-the grooved top plate at a specific angle, and force can be exerted not only in the direction in which the grooved top plate is pressed against the element substrate, but also in the direction in which the grooved top plate is retracted from the element substrate, so that these two components can be securely and stably bonded. To secure the grooved top plate to the element substrate, first, the pressing member is assembled with the reference member to which the element substrate is fixed, and the spring urging force of the pressing member is charged to obtain a gap through which the grooved top plate can be inserted. Then, the grooved top plate is inserted through the gap until it reaches a predetermined position, and the spring urging force of the pressing member is gradually released, so that the pressure exerted by the spring bonds the grooved top plate to the element substrate. Therefore, the conventional process for temporarily attaching the grooved top plate to the element substrate using an adhesive and using the pressing member to apply pressure to the resultant structure is not required, and the bonding process can be simplified. In addition, the positions of the grooved top plate and the element substrate can be precisely adjusted, and the bonding precision can be increased.

As is described above, according to the present invention the grooved top plate and the element substrate can be stably and securely bonded by using the pressing member, and the bonding conditions, such as accuracy and stability, of the grooved top plate and the element substrate can be improved. Furthermore, for a liquid jet recording head, the accuracy of the positioning of the discharge ports and the precision of droplet placement can be improved, and a precisely formed, high quality image can be obtained.

Since the process for assembling the liquid jet recording head can be simplified, the manufacturing yield can be improved, and secure contact can be realized.

It should be noted that in this specification, the term "charge" is used to denote a procedure in which a spring is bonded to a top plate, and the spring is deflected and maintained at such a position that a load exceeding the normal spring load occurs.

DETAILED DESCRIPTION OF THE PREFERRED EMBODIMENTS

A plurality of embodiments of the present invention will now be described while referring to the accompanying drawings.

Embodiment 1

Figure 1:
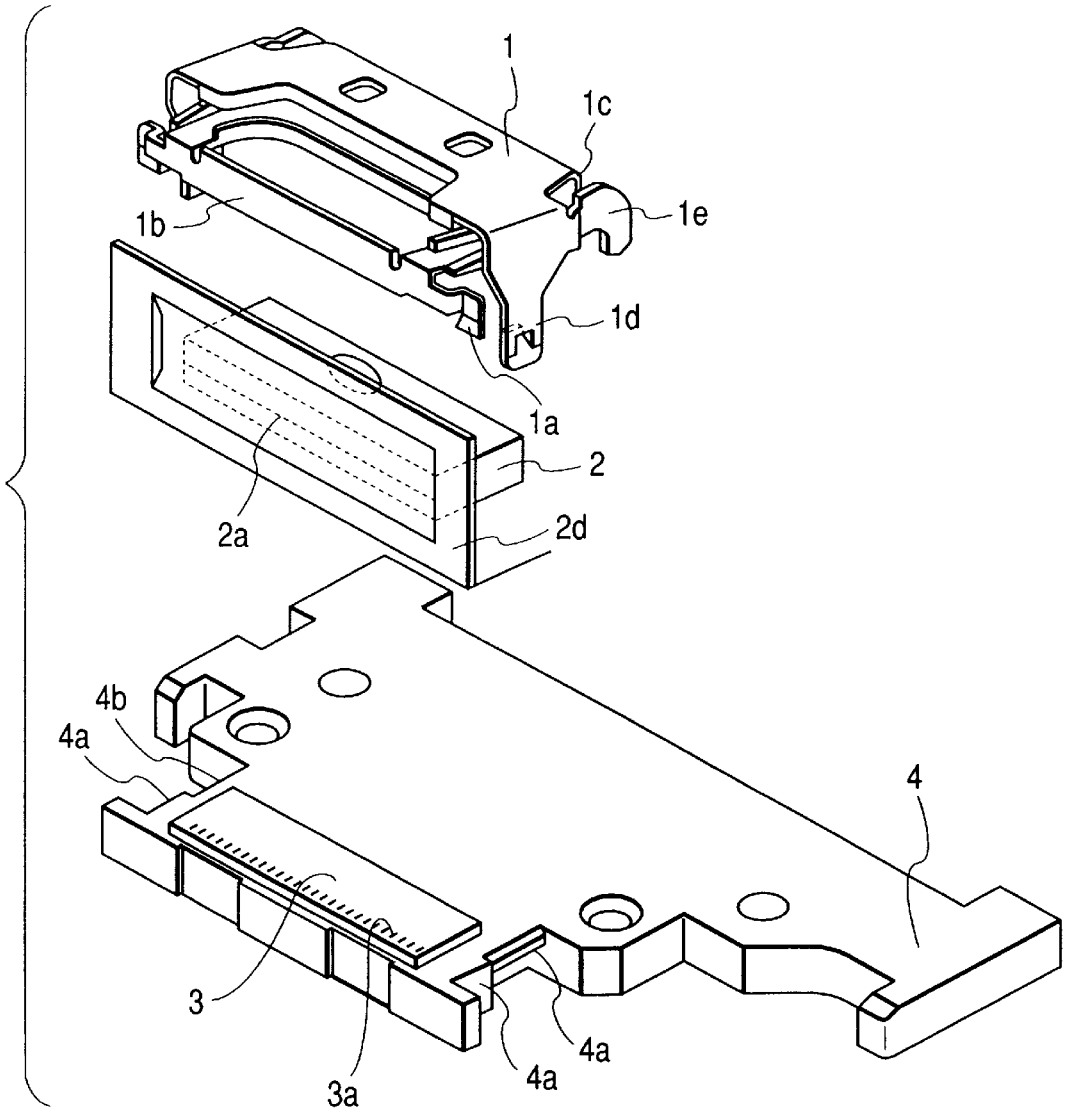
FIG. 1 is an exploded perspective view of the structure of the essential portion of a liquid jet recording head according to a first embodiment of the present invention.

FIG. 1 is an exploded perspective view of the structure of the essential portion of a liquid jet recording head according to the present invention.

Figure 2:
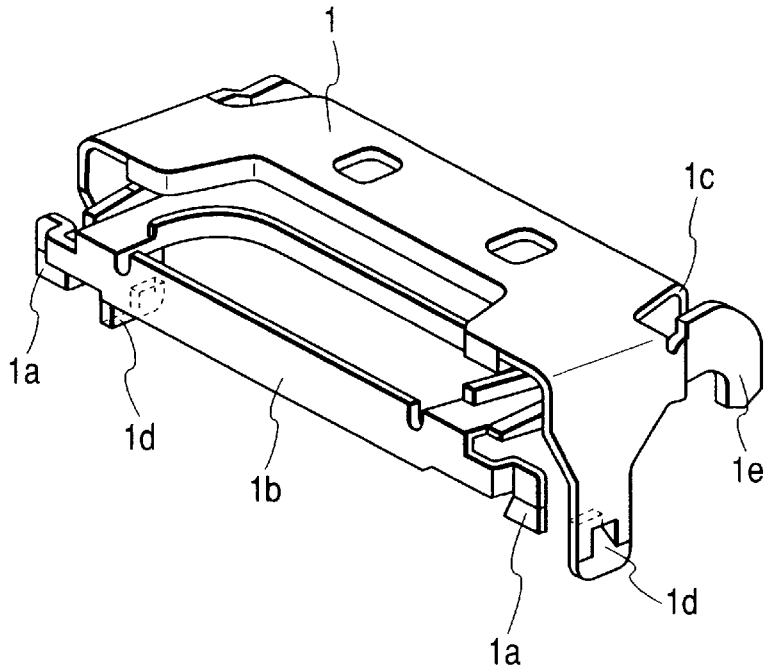
FIG. 2 is a perspective view of a pressing member that constitutes part of the liquid jet recording head according to the first embodiment of the present invention.
Figure 3:
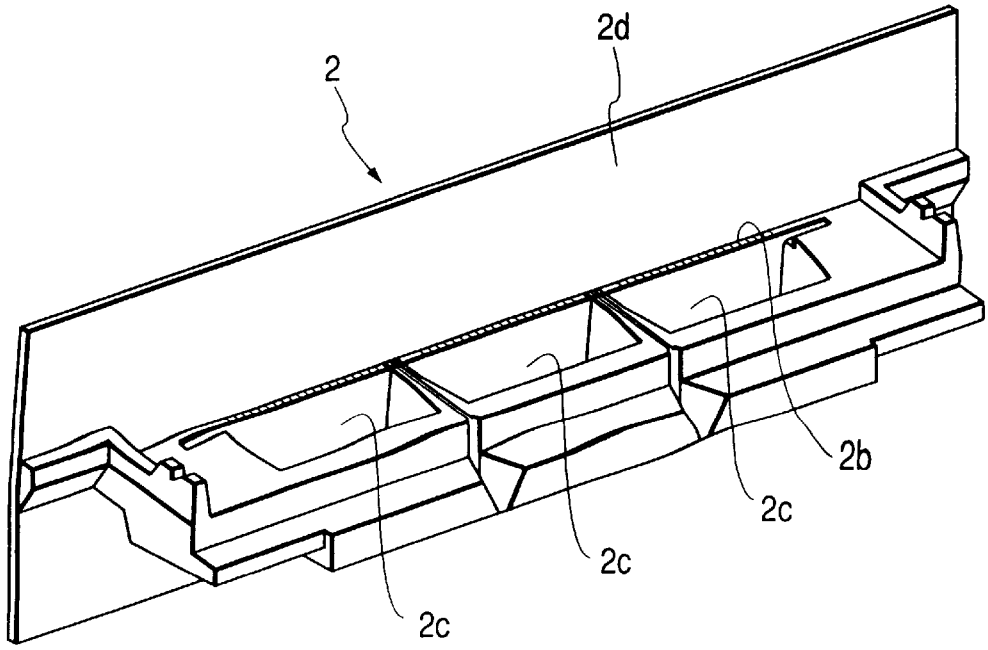
FIG. 3 is a perspective view of a grooved top plate that constitutes part of the liquid jet recording head according to the first embodiment of the present invention.

FIG. 2 is a perspective view of a pressing member that constitutes part of the liquid jet recording head of the present invention. FIG. 3 is a perspective view of a grooved top plate that constitutes part of the liquid jet recording head of the present invention.

The liquid jet recording head in this embodiment comprises, as is shown in FIG. 1, a pressing member 1; a grooved top plate 2, in which are formed a plurality of discharge ports 2*a*, for ejecting a recording liquid, and a plurality of liquid flow path grooves 2*b* (not shown in FIG. 1) that communicate with the individual discharge ports 2*a*; and an element substrate 3 attached to a base plate (standard or reference member) 4 at a predetermined position and provided with discharge energy generating elements 3*a*, which are electro-thermal converting elements for imparting discharge energy to the recording liquid. To assemble the liquid jet recording head, the grooved top plate 2 and the element substrate 3 are pressed together and secured by the pressing member 1.

In the detailed view of the structure in FIG. 2, the pressing member 1 comprises: a pressing portion 1*b*, which is extended along the array of the discharge ports 2*a*, and which contacts and applies pressure to the top face of the grooved top plate 2 in the vicinity of the discharge ports 2*a*; a U-shaped flexible portion 1*c*, which is bent into a U shape in cross section in order to provide a pressing force; a pair of engagement portions 1*d*, which are bent downward at both sides of the top face of the U-shaped flexible portion 1*c*, and which are provided with pawls for engaging engagement portions 4*b* formed in the base plate 4, a reference member; and a pair of abutting portions 1*e*, which extend rearward from the upper portion of the engagement portions 1*d* and are bent downward, and which contact the surface of the base plate 4 (reference member) and support, on the base plate 4, the forcing spring that acts on the pressing member 1. In addition, elastically operable projecting pieces (elastically deformable supporting portions) 1*a* are formed at either end of the pressing portion 1*b* and are used to charge the pressing (urging force) spring. The elastically operable pieces 1*a* are bent to the rear, away from the pressing portion 1*b* that contacts the grooved top plate 2, i.e., in the opposite direction to that in which the recording liquid is ejected, and extend downward beyond the lower edge of the pressing portion 1*b* that contacts the grooved top plate 2.

The element substrate 3, whereon discharge energy generating elements 3*a* such as electro-thermal converting elements are mounted, is securely fixed, using an adhesive, at a predetermined position on the surface of the base plate 4. As is shown in FIG. 1, engagement portions 4*b* are formed on both sides of the base plate 4 at positions that correspond to the engagement portions 1*d* of the pressing member 1, and notches 4*a* are formed the positions that correspond to the elastically operable portions 1*a* of the pressing member 1. The notches 4*a* engage and support the elastically operable portions 1*a* of the pressing member 1, and permit the passage of a displacing member, such as a charge pin, for changing the position of the pressing portion 1*b* of the pressing member 1.

As is shown in FIG. 3, the grooved top plate 2 comprises: a plurality of liquid flow path grooves 2*b*, corresponding to the discharge energy generating elements 3*a* formed on the element substrate 3; a plurality of common chambers 2*c*, which communicate with the liquid flow path grooves 2*b* and supply a recording liquid to the liquid flow path grooves 2*b*; and an orifice plate 2*d*, in which are formed discharge ports 2*a* (not shown in FIG. 3) that communicate with the liquid flow path grooves 2*b*.

The grooved top plate 2 and the element substrate 3 are aligned and joined so they have a predetermined positional relationship wherein the positions of the discharge ports 2*a* and the liquid flow path grooves 2*b* of the grooved top plate 2 correspond to the positions of the discharge energy generating elements 3*a* of the element substrate 3.

The pressing member 1 engages the engagement portions 4*b* of the base plate 4 using the pawls of the paired engagement portions 1*d*, and the paired abutting portions 1*e* contact the surface of the base plate 4. The elastically operable pieces 1*a* of the pressing member 1 are moved while being supported by the base plate 4, and thereafter are released. Then, using the force exerted by the pressing spring urging force of the pressing member 1, the pressing portion 1*b* of the pressing member 1 applies pressure, via a straight line contact, to the top face of the portion of the grooved top plate 2 that is in the vicinity of the discharge ports 2*a* and that contains the grooves that serve as the liquid flow path grooves 2*b*. As a result, the grooved top plate 2 and the element substrate 3 are joined together under pressure.

The procedures constituting the method for assembling the grooved top plate 2 and the element substrate 3 of the liquid jet recording head will now be described while referring to FIGS. 4A to 4D and 5E to 5H.

Figure 4A:
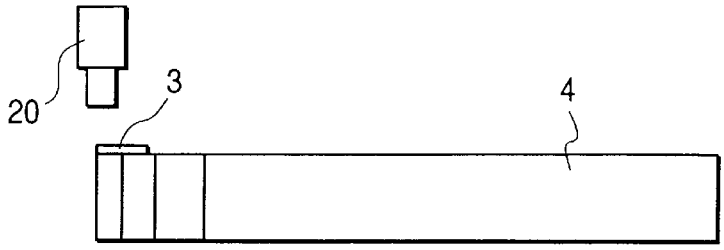
FIGS. 4A, 4B, 4C and 4D are diagrams showing the procedures employed for a method for assembling the grooved top plate, an element substrate and the pressing member of the liquid jet recording head of the present invention.

(1) FIG. 4A is a diagram showing the state wherein the element substrate 3 was securely bonded to the base plate 4 before the grooved top plate 2 and the pressing member 1 were assembled. The positions of the discharge energy generating elements 3*a*, which are formed on the element substrate 3 that is securely bonded to the base plate 4, are measured by an optical system 20, that is mounted on a tool (not shown) positioned above the assembly area. The thus obtained position data are stored.

Figure 4B:
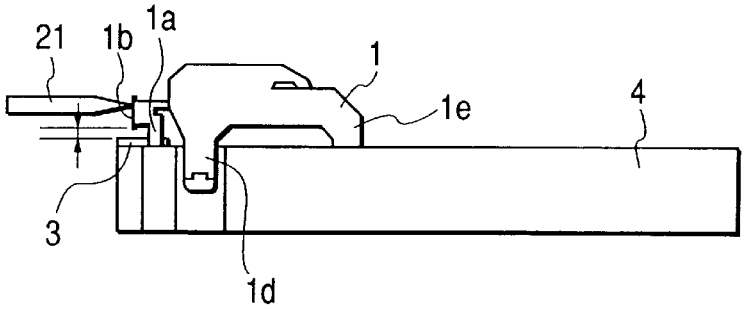

(2) FIG. 4B is a diagram showing the state wherein the pressing member 1 is mounted on the base plate 4. The paired engagement portions 1*a* of the pressing member 1 engage the engagement portions 4*b* of the base plate 4, and the paired abutting portions 1*e* of the pressing member 1 contact the surface of the base plate 4. At this time, the position of the distal end of the pressing member 1 is measured by a measuring mechanism 21, such as a contact displacement sensor, a laser displacement sensor or an image sensor. The measurement results are compared with the position data that were obtained for the discharge energy generating elements 3 of the element substrate 3, and the position of the pressing member 1 is adjusted as needed. Thus, the pressing member 1 is assembled while the element substrate 1 is accurately positioned.

Figure 6:
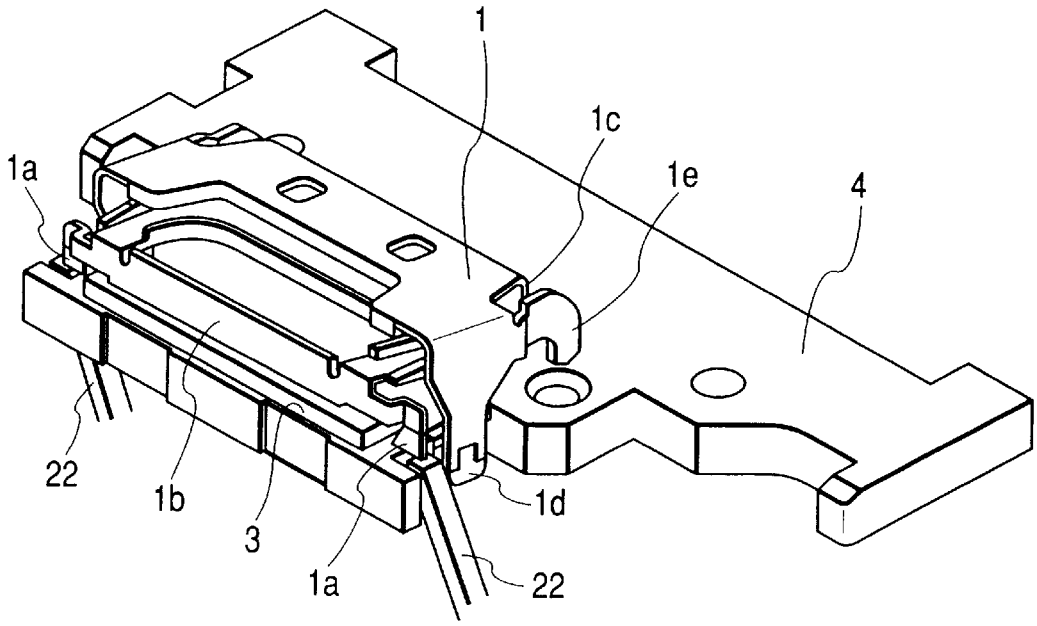
FIG. 6 is a perspective view of a unit for the liquid jet recording head according to the first embodiment where the pressing member is assembled with a base plate.

At this time, as is apparent from FIG. 6, parts of the lower ends of the elastically operable pieces 1*a* of the pressing member 1 are supported by the base plate 4. Therefore, the pressing portion 1*b* is held at a distance from the surface of the element substrate 3, and the pressing member 1*b* can not contact and scratch the surface of the element substrate 3.

Figure 4C:
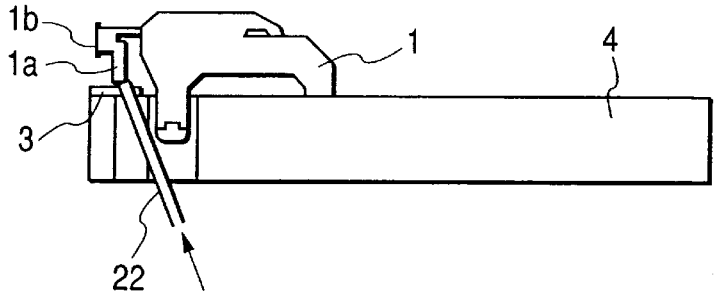

(3) Following this, the pressing portion 1*b* of the pressing member 1, which is mounted on the base plate 4, is raised, and held in that position, by the charge pins 22 of the spring charging mechanism so that a gap is formed through which the grooved top plate 2 can be inserted. The state wherein the pressing portion 1*b* of the pressing member 1 has been raised is shown in FIG. 4C. From below, the charge pins 22 are passed through the notches 4*a* that are formed at both sides of the base plate, and are moved obliquely upward and to the front so that they engage and then raise and support the elastically operable pieces 1*a* of the pressing member 1 (see FIG. 6 also). Through performance of this procedure, the pressing portion 1*b* of the pressing member 1 is also raised, and the forcing spring of the pressing member 1 is charged. At this time, to charge the forcing spring of the pressing member 1, it is preferable that the position whereat the charge pins 22 of the spring charge mechanism contact the pressing member 1 be closer to the pressing portion 1*b* of the pressing member 1.

Figure 4D:
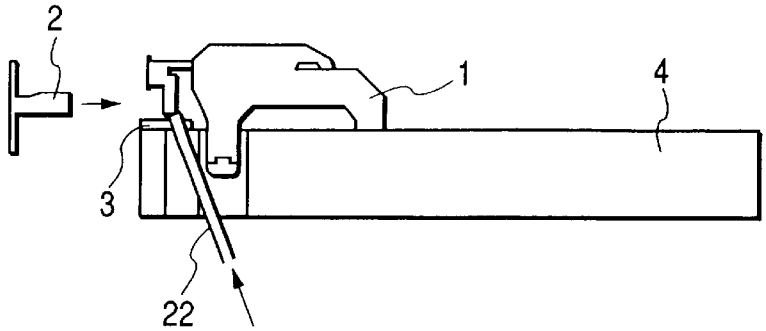

(4) The grooved top plate 2 is inserted between the element substrate 3 and the pressing portion 1*b* of the pressing member 1, which was raised and held by the charge pins 22 at a height that permitted the insertion of the grooved top plate 2 (see FIG. 4D).

Figure 5E:
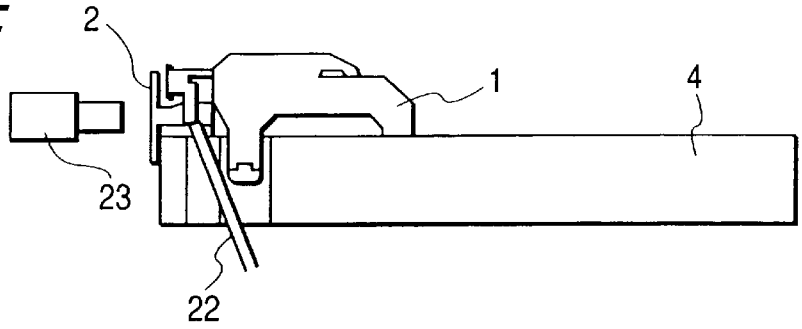
FIGS. 5E, 5F, 5G and 5H are diagrams that follow those in FIGS. 4A, 4B, 4C and 4D and show the procedures employed for the method for assembling the grooved top plate, the element substrate and the pressing member of the liquid jet recording head of the present invention.
Figure 5F:
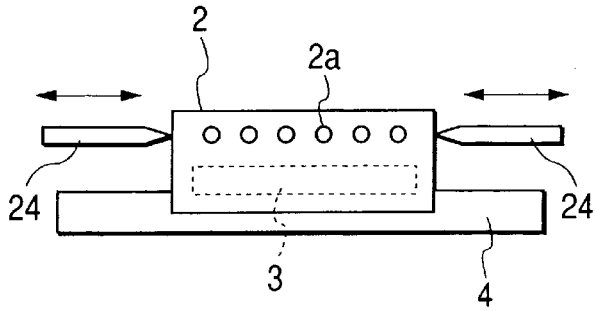

(5) FIG. 5E is a diagram showing the state wherein the grooved top plate 2 has been inserted between the element substrate 3 and the pressing member 1. The position of the grooved top plate 2, which can be moved horizontally, is then adjusted. That is, a second optical system 23, positioned in front of the discharge ports 2*a* of the grooved top plate 2, measures the positions of the discharge ports 2*a*, and at the same time, as is shown in FIG. 5F, from either side a plate alignment mechanism 24 is brought into contact with the grooved top plate 2 and precisely adjusts its position, based on the position information obtained by the second optical system 23 and the position data for the discharge energy generating element 3*a*, which was obtained in advance. As a result, the discharge energy generating elements 3*a* of the element substrate 3 and the discharge orifices 2*a* and the liquid flow path grooves 2*b* of the grooved top plate 2 are accurately aligned.

(6) When the discharge energy generating elements 3*a* of the element substrate 3 have been aligned with the discharge ports 2*a* and the liquid flow path grooves 2*b* of the grooved top plate 2, the charge pins 22 of the spring charge mechanism are moved downward to permit the elastically operable pieces 1*a* to descend, and the charging force exerted on the forcing spring of the pressing member 1 is removed. Therefore, the pressing portion 1*b* of the pressing member 1 is brought into contact with and presses against the location on the top face of the grooved top plate 2 that corresponds to the liquid flow path grooves of the grooved top plate 2, so that the grooved top plate 2 and the element substrate 3 are closely fixed (see FIGS. 5G and 5H). In FIG. 4B the elastically operable pieces 1*a* of the pressing member 1 contact the surface of the base plate 4; however, when the assembly of the grooved top plate 2 has been is completed, the elastically operable pieces 1*a* do not contact the base plate 4, and permit the pressing member 1 to apply to the grooved top plate 2 the pressure provided by the forcing spring (see FIG. 7 also).

As is described above, to bond the grooved top plate 2 to the element substrate 3, first, the pressing member 1 is mounted on the base plate 4 on which the element substrate 3 is fixed. Then the charge pins 22 are passed through the notches 4*a* in the base plate 4, and displace the pressing member 1 by engaging and lifting the elastically operable pieces 1*a*. Then, the grooved top plate 2 is inserted and located at a predetermined position, and the elastically operable pieces 1*a* of the pressing member 1 are gradually disengaged. As a result, the grooved top plate 2 and the element substrate 3 can be firmly joined together by the pressure provided by the forcing spring to the pressing member 1. Therefore, unlike the prior art, an adhesive need not be used to temporarily bond the grooved top plate to the element substrate before the two are pressed together and bonded by the pressing member, and thus the bonding process can be simplified and the bonding accuracy can be improved.

An explanation will now be given for the state wherein pressure is applied to the grooved top plate 2 by the pressing member 1.

Figure 7:
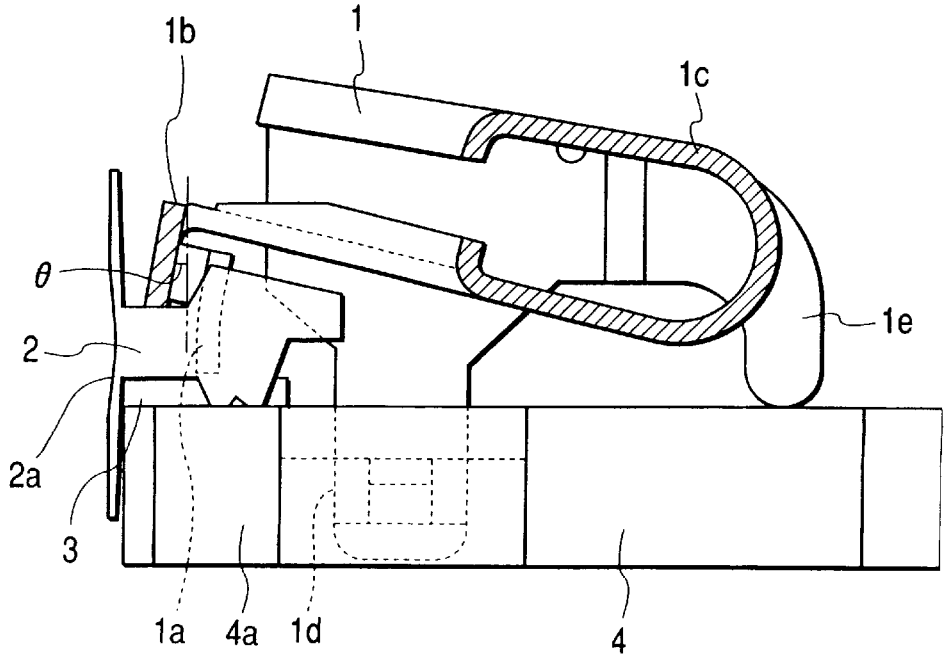
FIG. 7 is a cross-sectional view of the unit for the liquid jet recording head according to the first embodiment, wherein the grooved top plate, the element substrate and the pressing member, which is partially cut away, are assembled.

As is shown in FIG. 7, the inclination angle θ of the pressing portion 1*b* relative to the perpendicular direction of the element substrate 3 is set at approximately 10°. The load that is imposed on the grooved top plate 2 by the pressing member 1 acts not only in the direction in which the grooved top plate 2, which is perpendicular to the element substrate 3, is pressed against the element substrate 3, but also the direction in which the grooved top plate 2 is retracted in parallel to the element substrate 3. The retraction force is exerted by engaging and supporting the elastically operable pieces 1*a* that are formed on both sides of the pressing portion 1*b* of the pressing member 1. For example, when, as is shown in FIG. 6, the pressing portion 1*b* of the pressing member 1 in the non-loaded state is supported and moved by engaging the elastically operable portions 1*a* with the charge pins 22, the angle θ is increased. Therefore, the load is generated as a reactive force of displacement, not only in the direction perpendicular to the element substrate 3, but also in the direction in which the grooved top plate 2 is retracted, i.e., in the direction in which the angle θ is reduced. When the elastically operable pieces 1*a* are disengaged and the pressing member 1*b* is driven against the grooved top plate 2, pressure is applied to the element substrate 3 and the grooved top plate 2 is retracted. Due to the generation of the retraction force, the grooved top plate 2 does not fall off the element substrate 3, and they can be precisely and stably joined together. Therefore, so long as the grooved top plate 2 and the element substrate 3 are precisely aligned, these components can be accurately joined to each other.

Figure 5G:
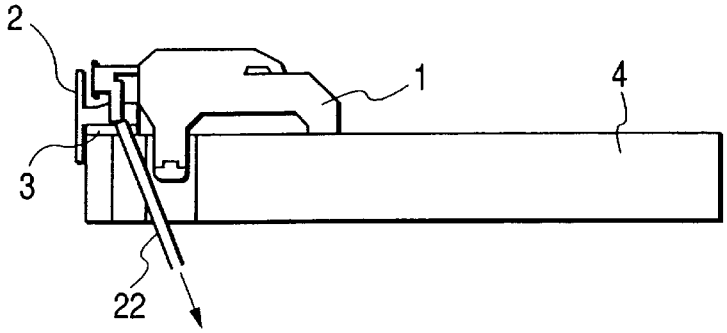
Figure 5H:
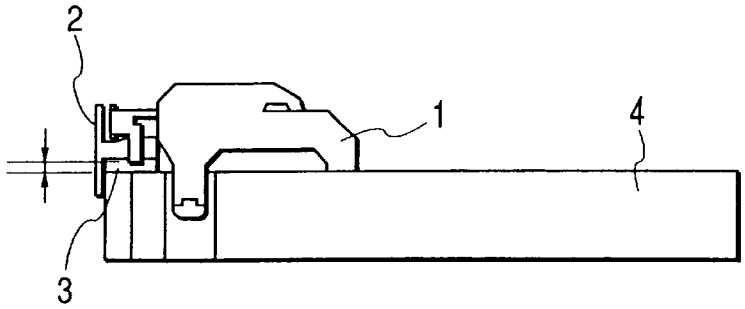

As is described above, after the forcing spring of the pressing member 1 is charged by moving the elastically operable pieces 1*a* using the charge pins 22, the grooved top plate 2 is inserted. Then, when the charge pins 22 are retracted and the pressing portion 1*b* of the pressing member 1 contacts and is pressed against the grooved element, the grooved top plate 2 and the element substrate 3 can be closely joined together. At this time, the charging pins 22 are moved vertically at a slight angle, as is shown in FIGS. 4C, 5G and 6. This angle can be employed to adjust the position whereat the grooved top plate 1 and the pressing member 1 (especially the pressing portion 1*b*) contact together. If the angle is increased, the distal end of the pressing portion 1*b* of the pressing member 1 is moved forward when the forcing spring of the pressing member 1 is charged, and a powerful force is exerted that pulls the grooved top plate 2 when pressure is applied to it. Therefore, the shifting of the grooved top plate 2 away from the element substrate 3, which is caused by a temperature change and an impact after the grooved top plate 2 has been secured, can be reduced. However, if the retraction force is too large, the grooved top plate 2 and the element substrate 3 may be shifted or the grooved top plate 2 may be deformed, so that an appropriate angle must be set.

In addition, if the elastically operable pieces 1*a* are wide, they can be securely engaged and supported by the charge pins 22 that pass through the notches 4*a* of the base plate 4. However, if the elastically operable pieces 1*a* are too wide, they are flexibly shifted by engagement with the charge pins 22, while the shifting and deformation of the pressing portion 1*b* does not follow. As a result, a satisfactory force for pulling the grooved top plate 2 is not exerted, and the pressing accuracy is deteriorated. Therefore, an appropriate width is required for the elastically operable pieces 1*a*.

Figure 8A:
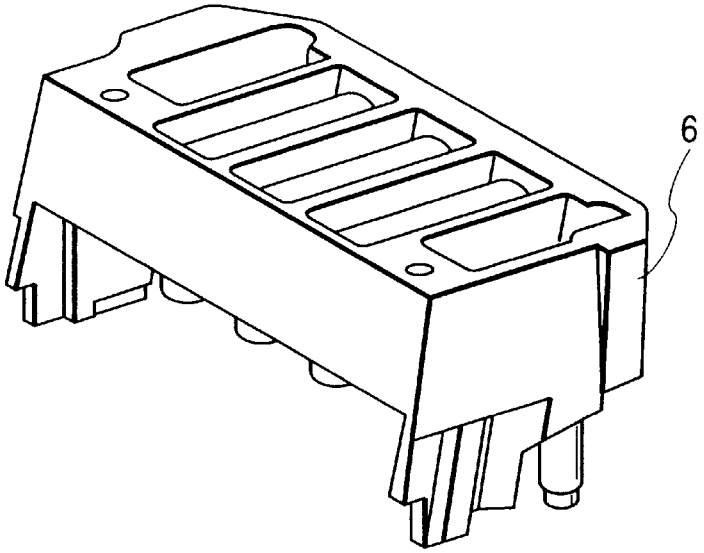
FIG. 8A is a perspective view of a flow path member used for the liquid jet recording head of the present invention.
Figure 8B:
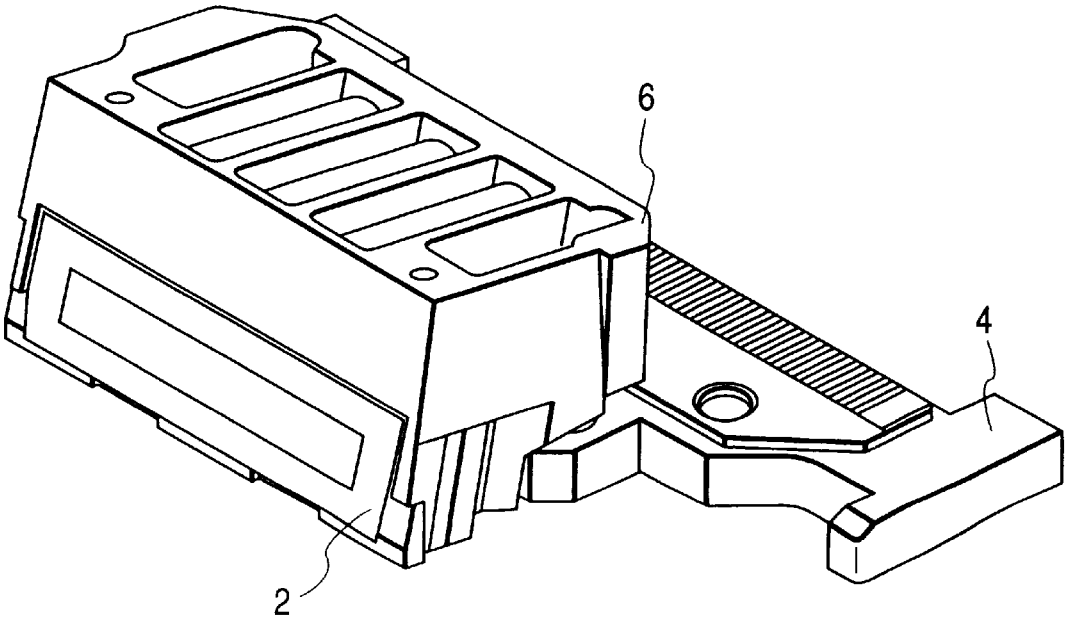
FIG. 8B is a perspective view of a liquid jet recording head provided by assembling the flow path member according to the present invention.

In this embodiment, the portions of the base plate 4 through which the charge pins 22 are inserted are defined as the notches 4*a*. Therefore, when the common liquid chambers 2*c* of the grooved top plate 2 that is bonded are to be mounted, over the pressing member 1, on a flow path member (chip tank) 6 (see FIG. 8A) for supplying a recording liquid from a recording liquid tank, the legs of the engagement portions 1*d*, etc., of the pressing member 1 can be covered by the legs of the flow path member 6. FIG. 8B is a diagram showing the state wherein the flow path member 6 has been mounted. With this structure, when a sealing agent is used to seal the bonded portion of the grooved top plate and the element substrate 3, the sealing agent can be prevented from running along the edges of the pressing member 1 to the reverse face of the base plate 4. In the prior art, the process for embedding the legs of the pressing member in advance with a sealing agent is required in order to prevent the leakage of the sealing agent from the legs. However, in this embodiment, such processing can be eliminated by employing the notched structure of the base plate 4 and the leg structure of the flow path member 6.

Figure 9:
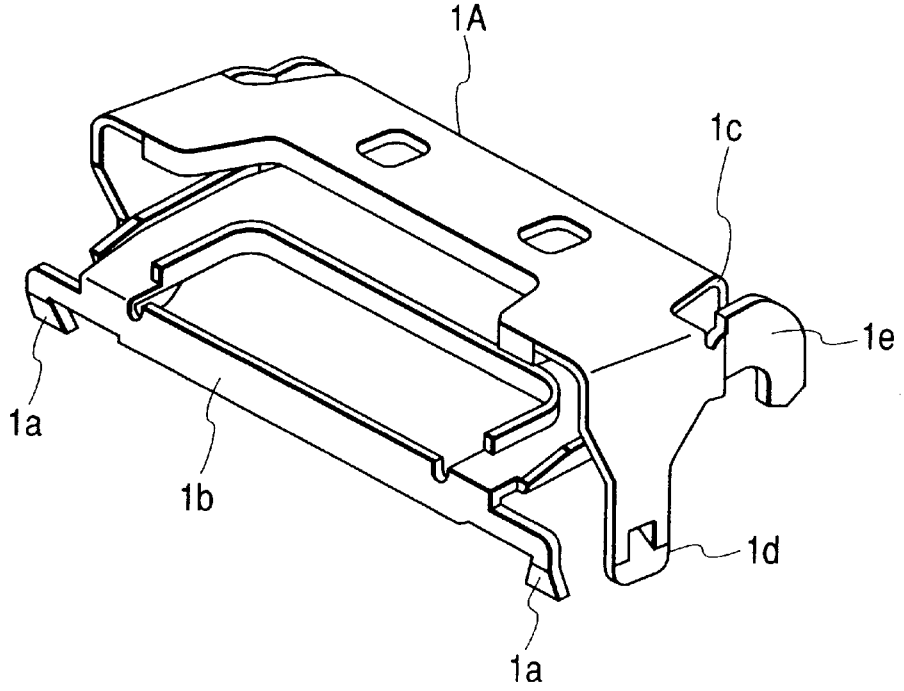
FIG. 9 is a perspective view of another pressing member that constitutes part of the liquid jet recording head according to the first embodiment of the present invention.

Another pressing member example for the present invention will now be described while referring to FIG. 9.

While taking the grooved top plate retraction force into account, it is preferable that the elastically operable pieces 1*a* of the pressing member 1 be located on the same plane as the pressing portion 1*b*. Thus, a pressing member 1A in this example has the same structure as the one in the above embodiment, except that, as is shown in FIG. 9, the elastically operable pieces 1*a* and the pressing portion 1*b* are arranged on the same plane.

In the embodiment, the elastically operable pieces 1*a* of the pressing member 1 or 1A are extended so that they are lower than the position at which the pressing portion 1*b* applies pressure to the grooved top plate 2. When the pressing member 1 or 1A is mounted on the base plate 43, as is shown in FIGS. 4B and 6, the elastically operable pieces 1*a* contact the base plate 4 and are supported. Therefore, the pressing portion 1*b* does not contact the element substrate 3 on the base plate 4, and damage to the element substrate 3 is prevented. However, when the pressing member 1 or 1A is mounted on the base plate 4, if the pressing member 1*b* does not contact the surface of the element substrate 3 unless a load is imposed by the pressing member 1, the elastically operable pieces 1*a* need not be extended until they are lower than the pressing portion 1*b*. In this case, both ends of the pressing portion 1*b* can be used as flexible operating portions that the charge pins engage.

An additional example of the pressing member of the present invention will now be described while referring to FIG. 10.

Figure 10:
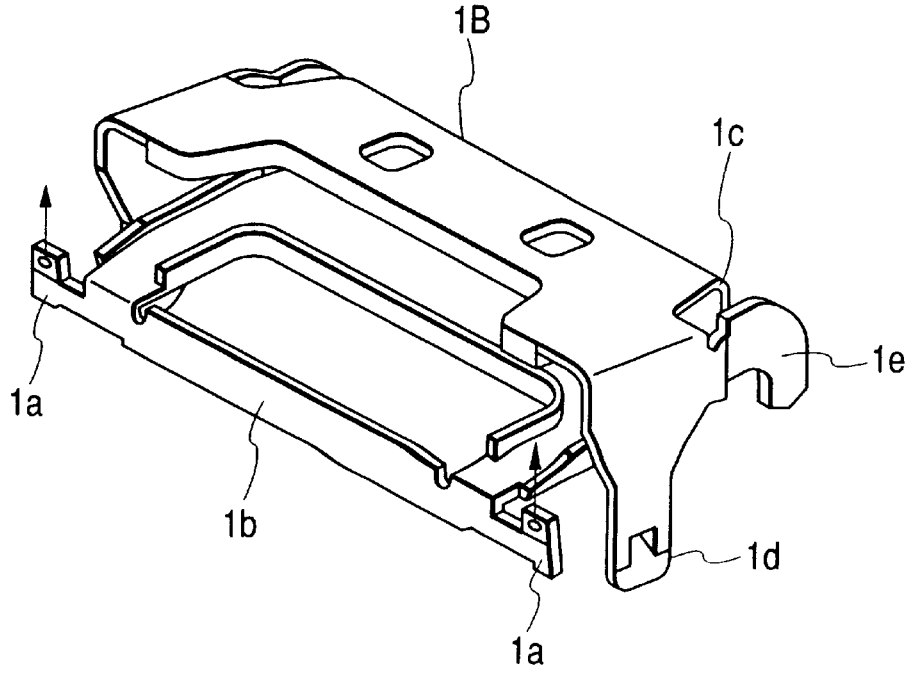
FIG. 10 is a perspective view of an additional pressing member that constitutes part of the liquid jet recording head according to the first embodiment of the present invention.

A pressing member 1B in this example pulls up and supports elastically operable pieces 1*a* from the side opposite that of the base plate 4 (i.e., from above the upper portion in FIG. 10). Since the elastically operable pieces 1*a* are supported from above, the pressing member 1B can be flexibly supported, without depending on the shape of the base plate 4. However, if the load supporting direction is perpendicular relative to the element substrate 3, and if the displacement support point is not positioned closer to the discharge port side from the displacement center point that is obtained by bending the foot of the pressing portion 1*b*, a load does not occur in the direction in which the grooved top plate is pulled. In other words, so long as the support point is present on the discharge port side, stable bonding can be performed.

An explanation will now be given, while referring to FIG. 11, for an apparatus for assembling the pressing member 1, the grooved top plate 2 and the element substrate 3 for the liquid jet recording head of the present invention.

The assembling apparatus comprises: a base plate discharge/supply station S1, which loads and positions, on a tool, a base plate on which an element substrate is mounted, and which removes the completed unit from the tool; a pressing member mounting station S2, which supplies a pressing member for mounting on the base plate and which raises the pressing member to a position at which a grooved top plate can be inserted; a plate supply station S3, which temporarily positions the grooved top plate and inserts it into position atop the element substrate; a plate alignment station S4, which aligns discharge energy generating elements on the element substrate, discharge ports and liquid flow path grooves, and closes the pressing member to secure the grooved top plate using the pressure supplied by the forcing spring of the pressing member; and a control station S5, which controls the operation of the individual stations.

Figure 11:
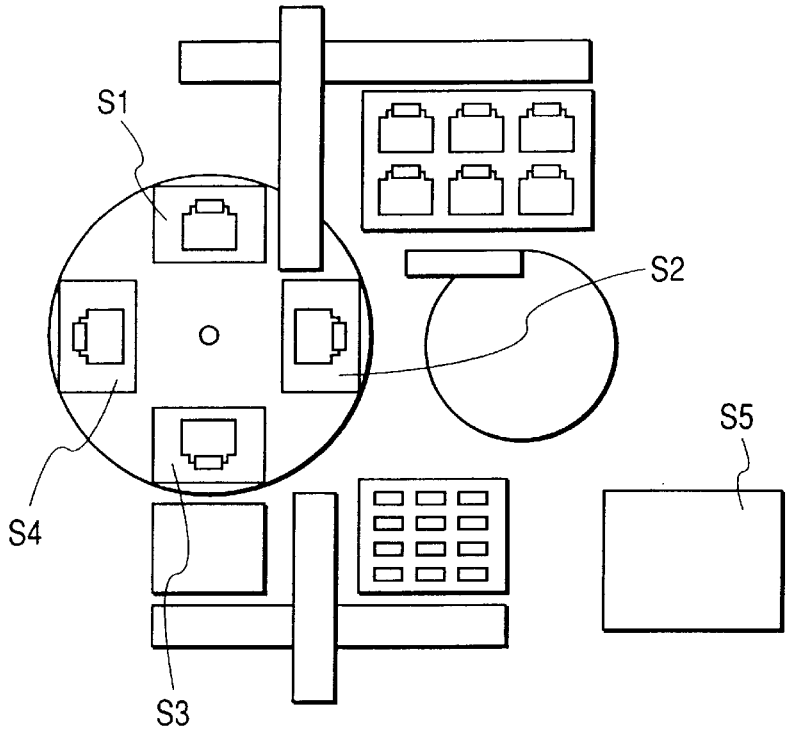
FIG. 11 is a schematic diagram illustrating the arrangement of an apparatus for assembling the liquid jet recording head of the present invention.

An explanation will be given, while again referring to FIGS. 4A to 4D and 5E to 5H, for the procedures performed when the assembling apparatus in FIG. 11 is employed to assemble a liquid jet recording head.

First, at the base plate discharge/supply station S1, the base plate 4 on which the element substrate 3 is securely bonded in advance is loaded into the assembling apparatus. The base plate 4 is positioned on a tool, and the optical system 20 measures the positions of the discharge energy generating elements 3*a* that are formed in the element substrate 3. The thus obtained position data are then stored (see FIG. 4A).

At the pressing member assembling station S2, the pressing member 1 is mounted on the base plate 4. The measuring mechanism 21 measures the position of the distal end of the pressing member, and adjusts it as needed, so that the pressing member 1 can be mounted at a precise position relative to the element substrate 3 (and the grooved top plate 2). Then, the charge pins 22 of the spring charge mechanism are employed to raise and hold the pressing portion 1*b* of the pressing member 1 at a position at which the grooved top plate 2 can be inserted (see FIGS. 4B and 4C).

While the pressing portion 1*b* of the pressing member 1 is held at that position by the charge pins 22, the obtained structure is moved to the plate supply station S3. Here, the grooved top plate 2 is inserted between the pressing portion 1*b* and the element substrate 3 (see FIG. 4D), and the position of the grooved top plate 2 is horizontally adjusted (see FIGS. 5E and 5F). Following this, when the forcing spring of the pressing member 1 is released by the charge pins 22, the pressing portion 1*b* of the pressing member 1 contacts and applies pressure to the top face of the grooved top plate 2, so as to tightly secure the grooved top plate 2 to the element substrate 3 (see FIGS. 5G and 5H).

Finally, the assembled liquid jet recording head is transferred to the discharge/supply station S1, and is discharged from the assembling apparatus.

Embodiment 2

Recently, as image quality has been improved by the overlapping of multiple recording liquids deposited on recording media, a demand has arisen for liquid jet recording heads that can provide higher recording speeds. One way in which this can be accomplished is by expanding the recording area that is covered during one scanning pass by the head.

However, for some grooved top plates wherein are formed a plurality of liquid flow path grooves that provide a recording width of more than 0.5 inches, liquid droplets ejected at the center of the flow path groove array are larger than the desired size, compared with droplets ejected at the ends of the groove array. According to a further analysis by the present inventor, when the recording width is increased, the opening provided by a pressing member is excessively extended in the direction that follows the flow path grooves. In addition, compared with a conventional recording head having a 0.5 recording width or smaller, a pressing member must be set to impose a greater load in order to provide the same pressure for each flow path groove. Therefore, it is assumed that when such a pressing member applies pressure to the grooved top plate, the end of the pressing portion may be deformed. And when the ends of a pressing member are deformed, the center of the flow path groove array tends to be bent upward, away from the substrate (as per the result of experiments conducted by the present inventor, it was found that some pressing members were bent several tens of $\mu$m). This bending causes a bonding failure between the grooved top plate and the element substrate near the center of the flow path groove array, a loss of discharge energy, and deterioration of the recording liquid ejection process. Especially when a recording head is designed to handle multiple recording liquid colors, partition walls between the common liquid chambers provided for the individual liquids are very high, and the above described problems tend to occur.

In this embodiment, therefore, multiple openings are formed opposite a plurality of recording liquid supply ports in the grooved top plate, and between the pressing portion and the flexible portion of the pressing member. Thus, openings are separately provided for the supply ports, beam portions between adjacent openings serve as reinforcement members for the pressing portion, and there is less deformation at the ends of the pressing member where it contacts and applies pressure to the grooved top plate. In order to cope with the request for higher liquid jet recording head performance, it is possible to provide, for the overall flow path groove array, a satisfactory bonded state for the grooved top plate, for which are formed multiple common liquid chambers and multiple flow path grooves having a recording width of more than 0.5 inches, and the element substrate in which the discharge energy generating elements are arranged. As a result, images having high definition and quality can be obtained.

The second-embodiment will now be described in detail while referring to the drawings.

Figure 12:
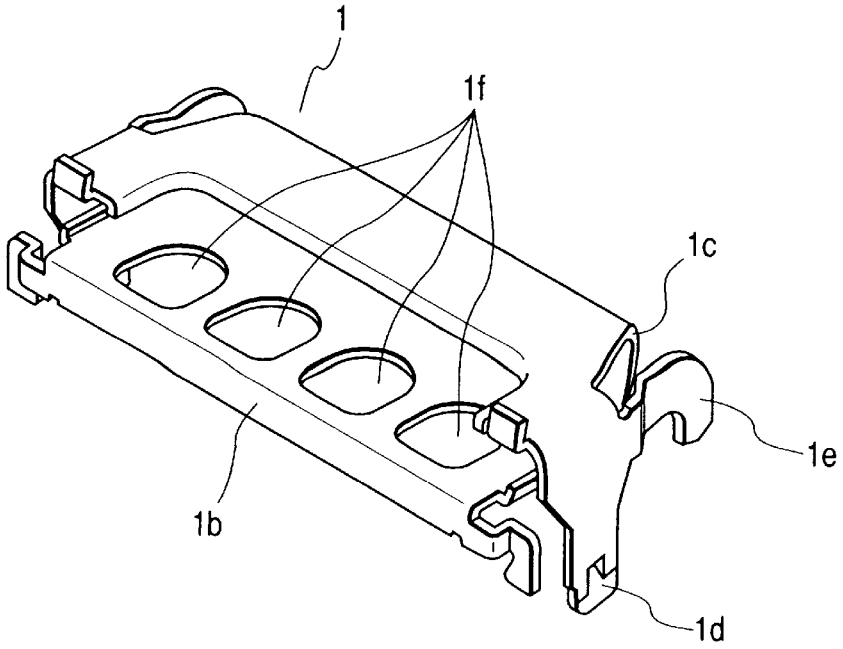
FIG. 12 is a perspective view of a pressing member that constitutes part of a liquid jet recording head according to a second embodiment of the present invention.
Figure 13:
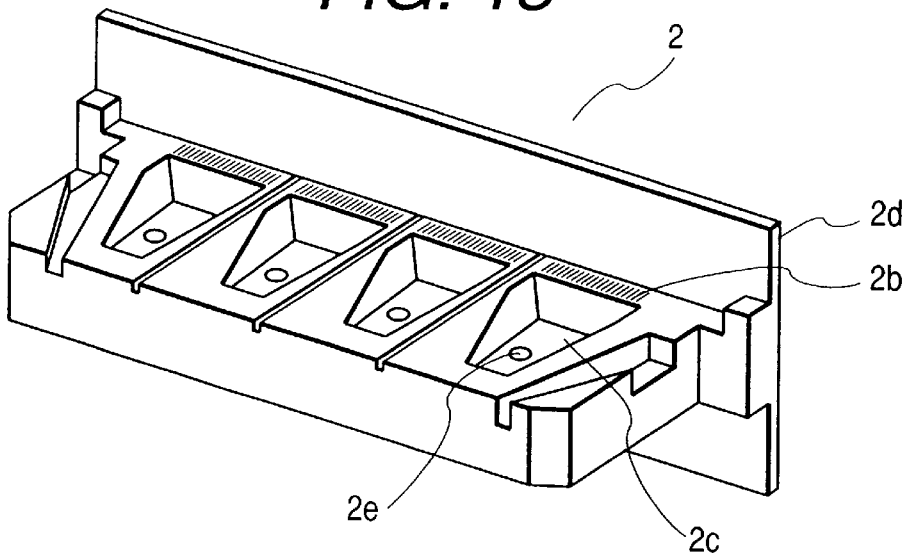
FIG. 13 is a perspective view of a grooved top plate that constitutes part of the liquid jet recording head according to the second embodiment of the present invention.
Figure 14:
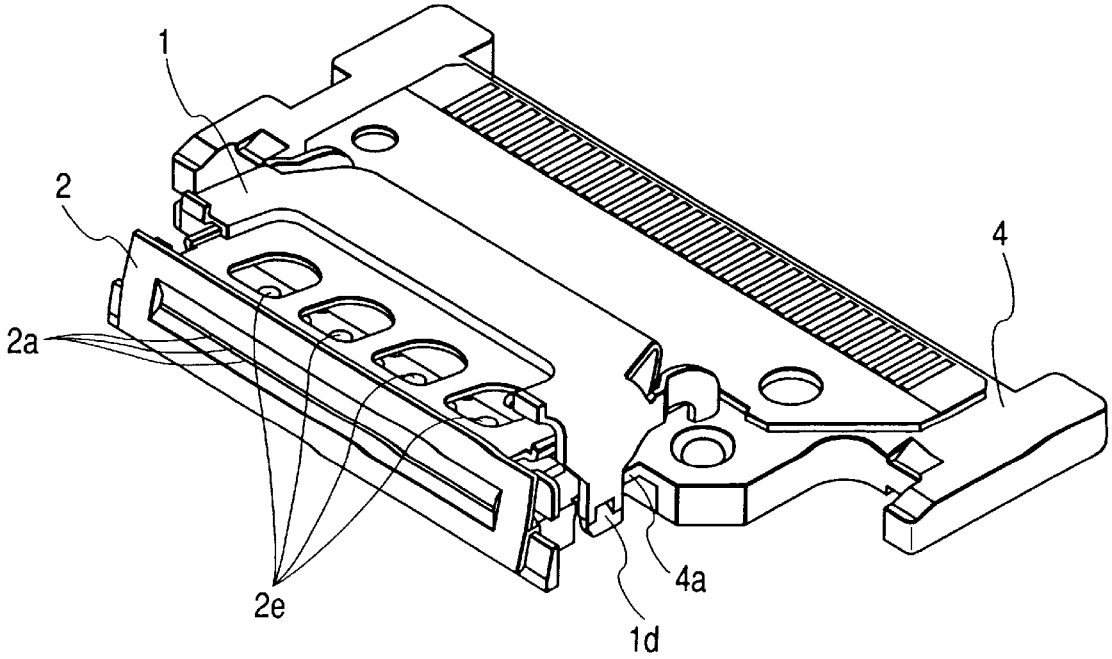
FIG. 14 is a perspective view of the structure of the essential portion of the liquid jet recording head according to the second embodiment of the present invention.
Figure 15:
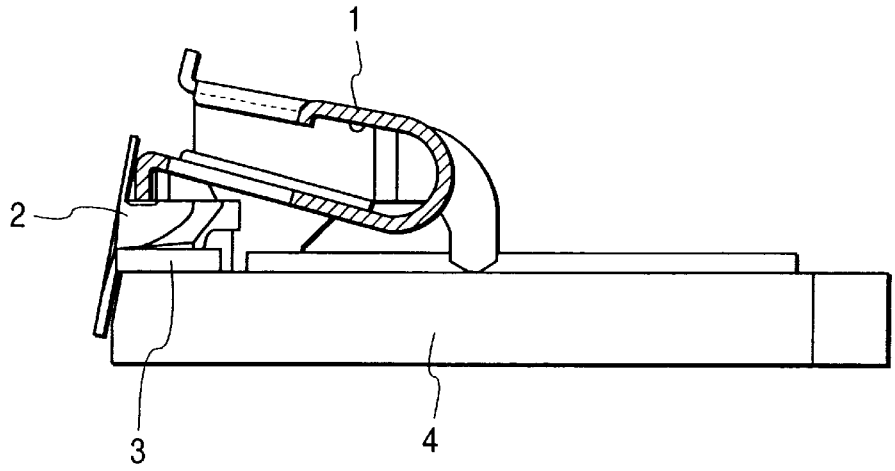
FIG. 15 is a cross-sectional view of the structure of the essential portion of the liquid jet recording head according to the second embodiment of the present invention.

FIG. 14 is a perspective view of the structure of the essential portion of a liquid jet recording head, and FIG. 15 is a cross-sectional view of the essential portion. FIG. 12 is a perspective view of a pressing member that constitutes part the liquid jet recording head. FIG. 13 is a perspective view of a grooved top plate that constitutes part the liquid jet recording head.

As is shown in FIGS. 14 and 15, the liquid jet recording head of this embodiment comprises: a pressing member 1; a grooved top plate 2, which includes a plurality of discharge ports 2*a* through which a recording liquid is ejected, and a plurality of flow path grooves 2*b* that communicate with the discharge ports 2*a*; an element substrate 3, which includes discharge energy generating elements, such as electrothermal converting elements for imparting discharge energy to a recording liquid; and a reference member 4, for securing the element substrate 3 at a predetermined position. Using the force provided by the forcing spring of the pressing member 1, a pressing portion 1*b* of the pressing member 1 applies pressure, via a straight line contact, to the top face of the portion of the grooved top plate 2 that is in the vicinity of the discharge ports and that includes the flow path grooves 2*b*. As a result, the grooved top plate 2 is bonded to the element substrate 3 by pressure.

As is shown in FIG. 13, the grooved top plate 2 comprises: an orifice plate 2*d*, wherein the discharge ports 2*a* for ejecting a recording liquid are formed; the flow path grooves 2*b*, which are formed so as to correspond to the discharge energy generating elements formed on the element substrate 3, and which communicate with the discharge ports 2*a*; a plurality of common liquid chambers 2*c*, which serve as temporary reservoirs for the recording liquid to be supplied to the flow path grooves 2*b*; and recording liquid supply ports 2*e*, which are connected to the individual common liquid chambers 2*c* to supply them recording liquid.

In the detailed structure as is shown in FIG. 12, the pressing member 1 comprises: a pressing portion 1*b*, which is extended in the direction in which the discharge ports 2*a* are arranged, and which contacts and applies pressure to the top face of the grooved top plate 2 in the vicinity of the discharge ports 2*a*; a flexible portion 1*c*, which is bent and in cross section has a U shape, to flexibly furnish a pressing force; a pair of engagement portions 1*d*, which are bent downward at both sides of the top face of the U-shaped flexible portion 1*c*, and which are provided with pawls to engage engagement portions 4*a* provided for the reference member 4; and a pair of abutting portions 1*e*, which extend to the rear from the upper portion of the engagement portions 1*d* and are bent downward, and which contact the surface of the reference member 4 and provide support, on the reference member 4, for the force that acts on the pressing member 1. Further, openings 1*f* are formed between the pressing portion 1*b* and the U-shaped flexible portion 1*c* in order to provide a channel that connects the recording liquid supply ports 2*e* of the grooved top plate 2 to an upstream recording liquid tank (not shown).

Figure 16:
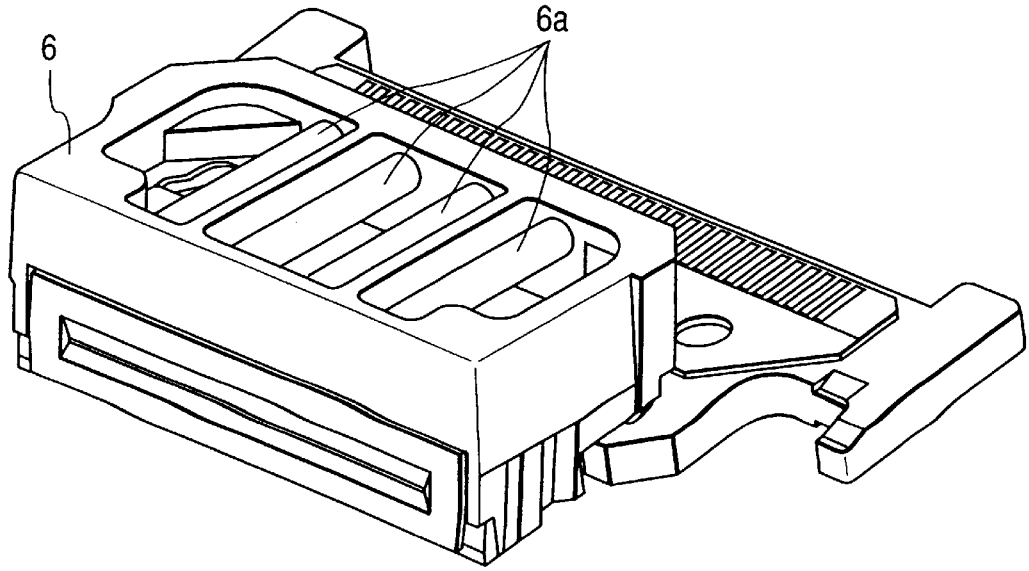
FIG. 16 is a perspective view of the state wherein a flow path member has been assembled with the essential portion of the liquid jet recording head according to the second embodiment of the present invention.
Figure 17:
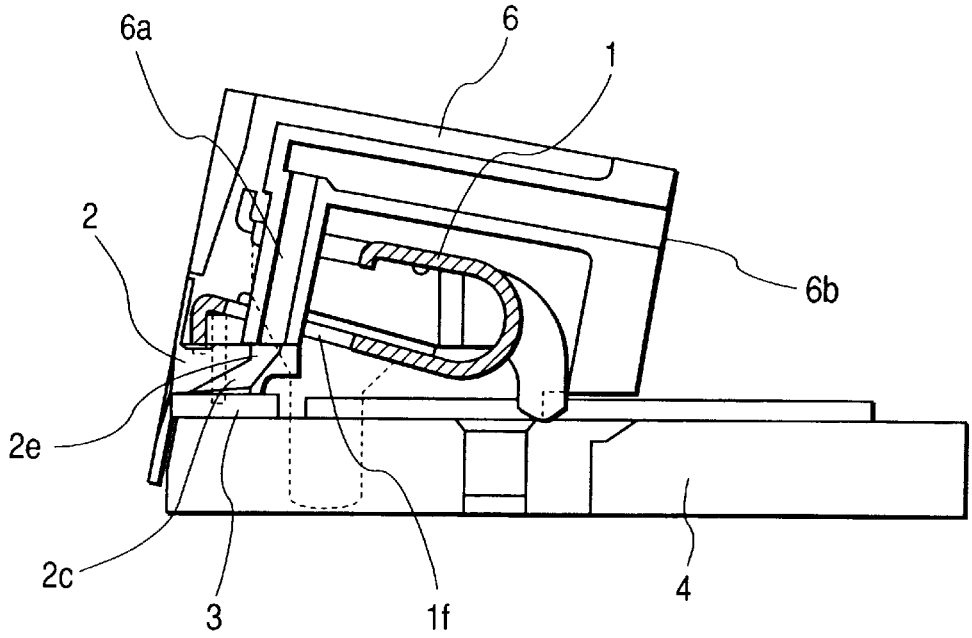
FIG. 17 is a cross-sectional view of the state wherein the flow path member has been assembled with the essential portion of the liquid jet recording head according to the second embodiment of the present invention.

As is shown in FIGS. 16 and 17, a flow path member 6 is employed to connect the recording liquid supply ports 2*e* of the grooved top plate 2 to the recording liquid tank. For the flow path member 6, a plurality of supply pipes 6*a* are formed corresponding to the recording liquid supply ports 2*e* of the grooved top plate 2, and supply ports 6*b* are open on the upstream side, such as on the recording liquid tank side, of the individual supply pipes 6*a*.

As is shown in the cross-sectional view in FIG. 17, the supply pipes 6*a* of the flow path member 6 enter the openings 1*f* of the pressing member 1, and their ends contact the recording liquid supply ports 2*e* of the grooved top plate 2, so as to form a channel for supplying the recording liquid to the grooved top plate 2.

As is described above, in order to connect the supply pipes 6*a* of the flow path member 6 to the recording liquid supply ports 2*e* of the grooved top plate 2, the openings 1*f* must be formed in the pressing member 1.

In this embodiment, in order to reduce the deformation of the pressing member 1, as is shown in FIG. 12 and 14, the openings 1*f* of the pressing member 1 are provided fin a number equivalent to the recording liquid supply ports 2*e* of the grooved top plate 2, and the partitions of the openings 1*f* serve as reinforcement members for the pressing member 1*b*.

According to the experiments conducted by the present inventor for a grooved top plate having a one-inch recording width, the pressing portion 1*b* of the pressing member 1 having only one opening was deformed several tens of $\mu$m, while the pressing portion 1*b* of the pressing member 1 in this embodiment, wherein openings 1*f* were allocated for the supply ports, was deformed only ten $\mu$m or less.

Modification

Figure 18:
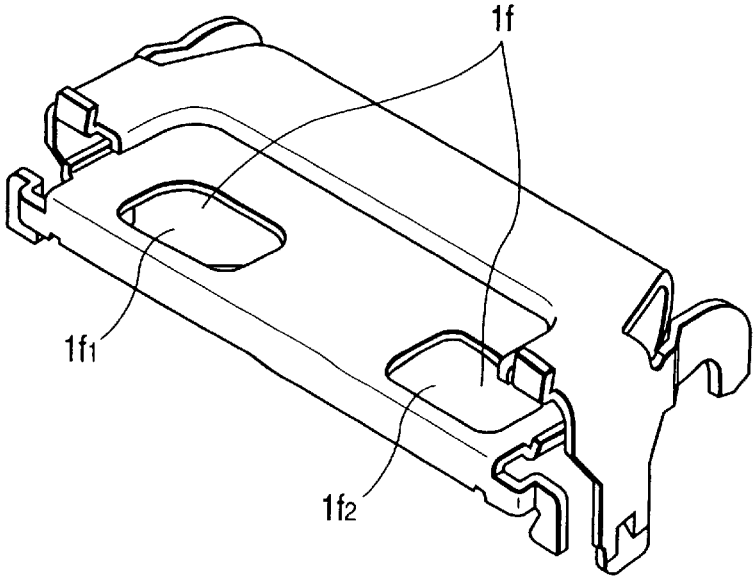
FIG. 18 is a perspective view of a modification of the pressing member that constitutes part of the liquid jet recording head according to the second embodiment of the present invention.

FIG. 18 is a perspective view of a modification of the pressing member 1.

Figure 19:
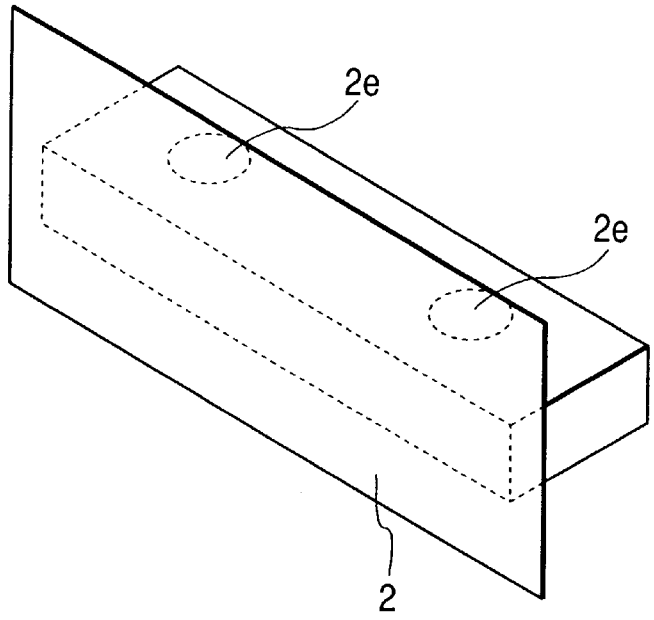
FIG. 19 is a perspective view of a modification of the grooved top plate that constitutes part of the liquid jet recording head according to the second embodiment of the present invention.

In FIG. 18, two openings 1*f* are formed in the pressing member 1. This pressing member 1 is effective for a grooved top plate 2 in FIG. 19 wherein two recording liquid supply ports 2*e* are formed.

Figure 20:
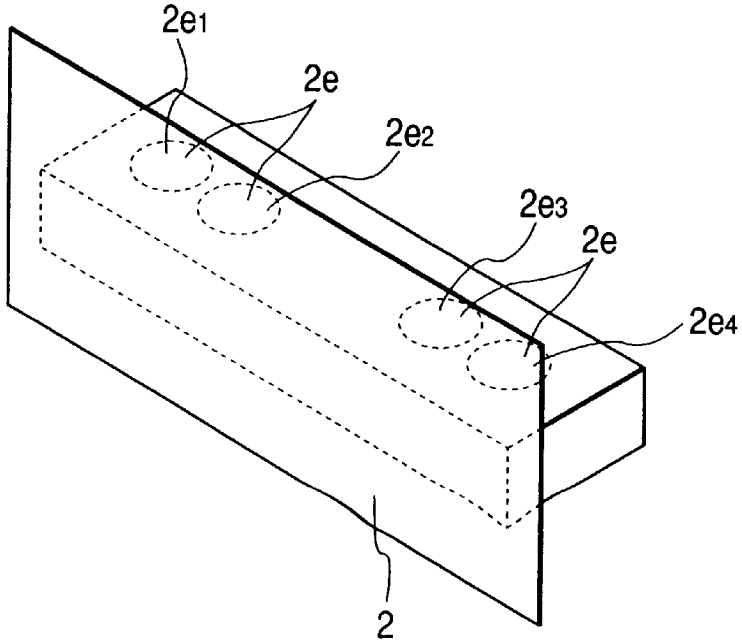
FIG. 20 is a perspective view of another modification of the grooved top plate that constitutes part of the liquid jet recording head according to the second embodiment of the present invention.

However, if more than two recording liquid supply ports 2*e* are formed in the grooved top plate 2, i.e., for example, if four recording supply ports 2*e* are formed at uneven intervals as is shown in FIG. 20, a pair of the recording liquid supply ports 2*e*1 and 2*e*2 can correspond to an opening 1*f*1, and a pair of the recording liquid supply ports 2*e*3 and 2*e*4 can correspond to an opening 1*f*2. In this case, the interval between the openings 1*f*1 and 1*f*2 in the pressing member 1 is extended as much as possible to obtain the maximum reinforcement.

What is claimed is:

1. A liquid jet recording head comprising:

an element substrate, fixed to a reference member, whereon are formed a plurality of discharge energy generating elements for generating discharge energy for discharging a recording liquid;

a grooved top plate, to be bonded to said element substrate, for forming a plurality of liquid flow paths, which correspond to said discharge energy generating elements, and a plurality of discharge ports, which communicate with said liquid flow paths, for the discharge of said recording liquid; and a pressing member paired with said reference member, which said pressing member engages, between which said grooved top plate and said element substrate are held in order for said grooved top plate to be pressed against said element substrate, said pressing member including a pressing portion, extended in a direction in which said discharge ports are arranged, for applying pressure to said grooved top plate in a vicinity of said discharge ports, a flexible portion for flexibly supporting said pressing portion, an engagement portion for engaging said reference member, and flexible operating portions located on either end of said pressing portion to charge a spring urging force.

2. A liquid jet recording head according to claim 1, wherein said flexible operating portions are formed as elastically operable pieces that extend downward below said pressing portion.

3. A liquid jet recording head according to claim 1, wherein said flexible operating portions are formed as elastically operable pieces that extend downward below said pressing portion and that are bent backward from said pressing portion in a liquid ejection direction.

4. A liquid jet recording head according to claim 1, wherein, before said grooved top plate is bonded to said element substrate, said pressing member is assembled with said reference member to which said element substrate is fixed.

5. A liquid jet recording head according to claim 4, wherein, when said pressing member is assembled with said reference member, to which said element substrate is fixed, and when said spring urging force of said pressing member has not yet been charged, said pressing portion of said pressing member does not contact said element substrate.

6. A liquid jet recording head according to claim 4, wherein, when said pressing member is assembled with said reference member, to which said element substrate is fixed, and when said spring urging force of said pressing member has not yet been charged, at least one part of each of said flexible operating portions of said pressing member is supported by said reference member, and said pressing portion of said pressing member does not contact said element substrate.

7. A liquid jet recording head according to claim 1, wherein said spring urging force of said pressing member, which is assembled with said reference member, is charged via said flexible operating portions, from below said reference member or from above said pressing member.

8. A liquid jet recording head according to claim 1, wherein, on either side of said reference member, notches are formed through which operating members can be passed to engage said flexible operating portions of said pressing member and to charge said spring urging force of said pressing member.

9. A liquid jet recording head according to claim 1, wherein, when said grooved top plate is inserted between said element substrate, which is fixed to said reference member, and said pressing portion of said pressing member, and wherein, when said pressing portion of said pressing member applies pressure in the vicinity of said discharge ports in said grooved top plate, said flexible operating portions of said pressing member are positioned at a distance from said reference member.

10. A liquid jet recording head according to claim 1, wherein said grooved top plate has a recessed portion in which are formed a plurality of common liquid chambers that communicate with said flow paths, and a plurality of recording liquid supply ports that correspond to said common liquid chambers; and wherein said pressing member has a plurality of openings between said pressing portion and said flexible portion, and said openings correspond to said recording liquid supply ports.

11. A liquid jet recording head assembly method whereby an element substrate, which is fixed to a reference member and on which are formed a plurality of discharge energy generating elements to generate discharge energy for an ejection of recording liquid, is bonded to a grooved top plate, in which are formed a plurality of liquid flow paths that correspond to said discharge energy generating elements and a plurality of discharge ports that communicate with said liquid flow paths for the ejection of said recording liquid, and whereby pressure exerted by a spring urging force of a pressing member secures said element substrate to said grooved top plate, said method comprising the steps of:

assembling said pressing member with said reference member to which said element substrate is fixed;

charging said spring urging force of said pressing member to obtain a gap through which said grooved top plate can be inserted;

assembling, by means of said gap, said grooved top plate with said element substrate; and releasing the charging of said spring urging force and by said spring urging force of said pressing member pressing said grooved top plate against said element substrate, so as to secure said grooved top plate to said element substrate.

12. A liquid jet recording head assembly method according to claim 11, wherein said pressing member includes:

a pressing portion, which extends in a direction in which said discharge ports are arranged in said grooved top plate, for applying pressure to said grooved top plate in a vicinity of said discharge ports;

a flexible portion for flexibly supporting said pressing portion;

engagement portions for engaging said reference member; and flexible operating portions, which are located at either end of said pressing portion, for charging a spring urging force.

13. A liquid jet recording head assembly method according to claim 12, wherein, when said pressing member is assembled with said reference member and when said spring urging force of said pressing member has not yet been charged, said pressing portion of said pressing member does not contact said element substrate.

14. A liquid jet recording head assembly method according to claim 12, wherein, when said pressing member is assembled with said reference member and when said spring urging force of said pressing member has not yet been charged, at least one part of each of said flexible operating portions, which extends downward from said pressing portion of said pressing member, is supported by said reference member, and said pressing portion of said pressing member does not contact said element substrate.

15. A liquid jet recording head assembly method according to claim 12, wherein said spring urging force of said pressing member, which is assembled with said reference member, is charged from below said reference member, or from above said pressing member.

16. A liquid jet recording head assembly method according to claim 11, wherein said spring urging force of said pressing member is charged by engaging, from below said reference member through notches that are formed in both sides of said reference member, said flexible operating portions of said pressing member.

17. A liquid jet recording head assembly method according to claim 11, wherein said grooved top plate is inserted between said pressing member, which is assembled with said reference member, and said element substrate; wherein said grooved top plate and said element substrate are moved to adjust their relative positions; and wherein said grooved top plate is pressed against and securely attached to said element substrate by pressure exerted by said spring urging force of said pressing member.

* * * * *

UNITED STATES PATENT AND TRADEMARK OFFICE

CERTIFICATE OF CORRECTION

PATENT NO. : 6,227,645 B1
DATED : May 8, 2001
INVENTOR(S) : Takahashi et al.

It is certified that error appears in the above-identified patent and that said Letters Patent is hereby corrected as shown below:

Title page,
Item [57] ABSTRACT,
Line 7, "element," shoud read -- element substrate, --.

Column 5,
Line 51, "to-the" should read -- to the --.

Column 8,
Line 29, "formed the" should read -- formed at --.

Column 9,
Line 31, "can not" should read -- cannot --.

Column 10,
Line 23, "has been" should be deleted.

Column 13,
Line 46, "0.5 inches," should read -- 0.5 inch, --.
Line 54, "0.5" should read -- 0.5 inch --.

Column 14,
Line 4, "above described" should read -- above-described --.
Line 19, "0.5 inches," should read -- 0.5 inch, --.
Line 28, "part" should read -- a part of --
Line 30, "part" should read -- a part of --.

UNITED STATES PATENT AND TRADEMARK OFFICE

CERTIFICATE OF CORRECTION

PATENT NO. : 6,227,645 B1
DATED : May 8, 2001
INVENTOR(S) : Takahashi et al.

It is certified that error appears in the above-identified patent and that said Letters Patent is hereby corrected as shown below:

Column 15,
Line 36, "fin" should read -- in --.

Column 18,
Line 28, "claim 12," should read -- claim 11, --.
Line 33, "claim 11," should read -- claim 12, --.

Signed and Sealed this

Twenty-seventh of November, 2001

*Attest:*

Nicholas P. Godici

*Attesting Officer*

NICHOLAS P. GODICI
*Acting Director of the United States Patent and Trademark Office*

UNITED STATES PATENT AND TRADEMARK OFFICE

CERTIFICATE OF CORRECTION

PATENT NO. : 6,227,645 B1
DATED : May 8, 2001
INVENTOR(S) : Takahashi et al.

It is certified that error appears in the above-identified patent and that said Letters Patent is hereby corrected as shown below:

Title page,
Item [30], Foreign Application Priority Data:

"Oct. 26, 1998 (JP) ..... 11-303272
Oct. 27, 1998 (JP) ..... 10-321450" should read -- Oct. 27, 1998 (JP) ..... 10-321450
Oct. 26, 1999 (JP) ..... 11-303272 --

Signed and Sealed this

Twelfth Day of February, 2002

*Attest:*

*Attesting Officer*

JAMES E. ROGAN
*Director of the United States Patent and Trademark Office*